US005449441A

United States Patent [19]

Amor et al.

[11] Patent Number: 5,449,441

[45] Date of Patent: Sep. 12, 1995

[54] ELECTROCHEMICALLY ROUGHENING ALUMINUM SHEET

[75] Inventors: Martin P. Amor, Cropredy; Peter R. Andrews, Middleton Cheney; Jonathan Ball, Clifton, all of United Kingdom; Peter K. F. Limbach, Göttingen, Germany

[73] Assignee: Alcan International Limited, Montreal, Canada

[21] Appl. No.: 157,071

[22] PCT Filed: Jun. 5, 1992

[86] PCT No.: PCT/EP92/01264

§ 371 Date: Mar. 8, 1994

§ 102(e) Date: Mar. 8, 1994

[87] PCT Pub. No.: WO92/21795

PCT Pub. Date: Dec. 10, 1992

[30] Foreign Application Priority Data

Jun. 6, 1991 [GB] United Kingdom ..... 9112211

[51] Int. Cl.[6] ..... C25F 3/04

[52] U.S. Cl. ..... 204/129.4; 204/129.43; 204/DIG. 9; 204/129.75

[58] Field of Search ..... 204/129.4, 129.43, 129.75, 204/DIG. 9

[56] References Cited

U.S. PATENT DOCUMENTS

| | | | |
|---|---|---|---|
| 4,468,295 | 8/1984 | Pliefke | 204/129.4 X |
| 4,482,434 | 11/1984 | Pliefke | 204/DIG. 9 X |
| 4,545,875 | 10/1985 | Riley | 204/DIG. 9 X |
| 4,561,944 | 12/1985 | Sasaki et al. | 204/129.35 X |
| 4,897,168 | 1/1990 | Boergerding et al. | 204/129.43 |
| 5,141,605 | 8/1992 | Nishino et al. | 204/129.4 X |
| 5,264,110 | 11/1993 | Atkinson et al. | 204/129.4 X |

FOREIGN PATENT DOCUMENTS 1621187 6/1971 Germany .

*Primary Examiner*—Donald R. Valentine
*Attorney, Agent, or Firm*—Cooper & Dunham

[57] ABSTRACT

Aluminum sheet is electrochemically roughened for use as a lithographic printing plate support or as capacitor foil. The alternating current used for electrochemical roughening is initially biased in a first way, e.g. anodically, and then in a second way, e.g. cathodically. Each biased current is sufficient at least to initiate formation of a pitting structure on the surface of the sheet. The method allows improved control over the pitting structure and more rapid electrograining of the sheet.

8 Claims, 1 Drawing Sheet

ELECTROCHEMICALLY ROUGHENING ALUMINUM SHEET

Figure 1:
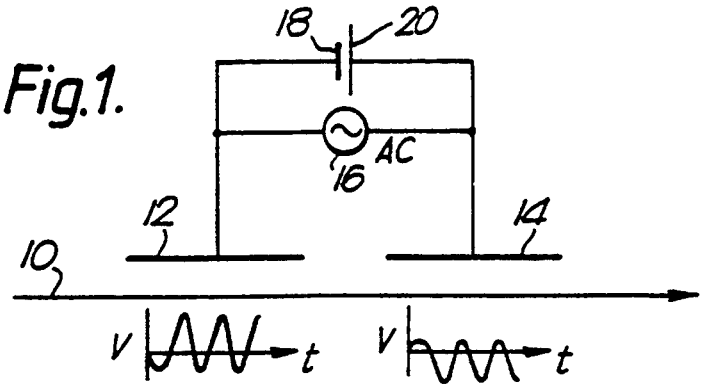

This invention relates to a method of electrochemically roughening an Al sheet, mainly for use as a lithographic plate support or a capacitor foil.

To make an aluminium sheet suitable for use as a lithographic plate support, the surface needs to be roughened or grained. Standard techniques for this include: mechanical graining by the use of balls or abrasives or wire brushes; electrochemical graining, by the application of an AC current in an acidic electrolyte; and chemical graining, by simple immersion in an etch. Roughening is carried out in order to enhance the adhesion of a photosensitive coating on the support, and to improve the water retention properties of the uncoated support surface, Irradiation and development of a lithographic plate generally result in ink-receptive image areas and water-retaining non-image areas, the latter generally being the uncovered support surface. For this purpose the aluminium sheet needs to be roughened on a scale of approximately 1–15 μm.

This invention is concerned with an improvement in the electrochemical graining or roughening technique. It is known to subject the Al sheet to AC, the current being biased in the anodic direction. It is also known to subject the Al sheet to AC with the current biased in the cathodic direction. Different advantages are claimed for the two alternatives. But neither alternative is effective to achieve uniform graining of the Al sheet on a desired scale, and in the shortest possible time. In the economics of this industry, time considerations are of paramount importance. In commercial electrochemical graining, sheet is passed continuously through a long bath of electrolyte; treatment time determines the speed of passage of the sheet, and the length of the bath and hence the amount of electrolyte used.

U.S. Pat. No. 4,468,295 (Hoechst) describes an electrochemical roughening technique in which Al sheet is subjected to two superimposed alternating currents having different frequencies, the ratio of the frequencies being from 3 to 100. This is claimed to improve the uniformity of the electrochemical graining, but it is not suggested that the treatment time is reduced. In continuous operation, different parts of the Al sheet would be subjected to different initial treatment conditions, which would be expected to produce a banded and therefore non-uniform result.

U.S. Pat. No. 4,561,944 (Fuji) describes a two-step or three-step graining treatment. Al sheet is first mechanically roughened, then optionally chemically etched, and finally electrochemically roughened by means of AC biased on the cathodic side. Because several roughening steps are involved, this treatment is relatively expensive.

U.S. Pat. No. 4,897,168 describes a process for the production of a roughened aluminium printing plate support by means of a pulsed direct current in an acidic electrolyte. During roughening the plate is mainly anodic. The roughened plate may thereafter be subjected to the cathodic half of the power supply which may exert a cleaning effect.

It is an object of this invention to provide a method for electrochemical roughening of Al sheet, in which the graining is uniform and on a desired scale, and which is effected as quickly or more quickly than conventional techniques.

The invention provides a method of electrochemically roughening a surface of an Al sheet, by subjecting the sheet in an aqueous electrolyte to the action of an alternating electric current, characterised in that the AC is initially biased in a first way for a time sufficient at least to initiate formation of a first pitting structure on the surface, and is then biased in a second way for a time sufficient at least to initiate formation of a second pitting structure on the surface, wherein the bias in the cathodic direction is of limited extent, such that the ratio of the areas, on opposite sides of a zero potential line under the curve of a voltage/time plot, is no greater than about 3:1.

The following observations led up to the present invention. Microscopic examination of conventional commercial electrochemically roughened Al sheets showed the presence of pits of at least two different sizes. There were large pits of average diameter 10 to 20 μm; and smaller pits of average diameter 1 to 10 μm, generally accompanied also by pits of sub-micron size. The surface consisted of larger pits and plateaus between them, both the larger pits and the plateaus being themselves pitted with smaller pits. This structure with a range of pit sizes is believed particularly suitable for lithographic sheet.

The inventors also performed experiments in which a direct current was superimposed on the alternating current being used for electrochemical roughening. They observed two effects:

i) The time required to pass a given amount of electricity (measured in Coulombs per unit area) required for electrochemical roughening, depended substantially on the nature of the imposed direct current. If the potential of the Al sheet was biased in an anodic direction, then the time required was reduced. If the potential of the Al sheet was biased in a cathodic direction, then the time required was increased. These effects were substantial, up to 50% change in relation to the unbiased value, and would be important in commercial operation.

ii) The microstructure of the treated surface depended on the bias. When a direct current was superimposed on an alternating current, so that the Al sheet is made more anodic than would otherwise be the case, large pits appeared and grew with increasing time, but there remained between them substantial plateau areas which were not pitted at all. When the applied current was biased in the cathodic direction (i.e. by making the Al sheet more cathodic than would otherwise be the case), a large number of smaller pits was formed which gradually covered the entire surface.

The idea of this invention is to combine the best features of both these alternatives. Treatment with AC having an anodic bias rapidly produces a structure of relatively large pits. Treatment with AC having a cathodic bias more slowly produces a surface completely covered with smaller pits. By suitable changes in the applied electrical current, control can be exercised over the microstructure of the treated Al sheet, and the electrochemical roughening process can be effected as fast or faster than is possible under any single set of conditions.

The Al sheet is subjected to the action of an alternating electric current. The wave shape (in a graph of voltage against time) may be sinusoidal or triangular or square or any convenient shape. The voltage is usually chosen to be as high as possible, while avoiding localised hot spots, so as to effect treatment in the shortest possible time. A typical continuous commercial line may operate at 30 to 60 V and 50–200 A/dm$^2$.

In this invention, the alternating current is initially biased in a first way, and is then biased in a second way. In continuous operation, this means that the Al sheet passes from a first region in which its potential is biased in a first way, to a second region in which its potential is biased in a second way. The bias may be effected by superimposing a direct current on the alternating current. Alternatively, the bias can be effected by any means which ensures that the amount of electricity passed in one half of the AC cycle is different from the amount passed in the other half. For example, one half of the cycle can be made shorter or have a lower voltage than the other. In a liquid contact cell a natural bias is set up on the aluminium surface that results from the forward and reverse components of the current being only approximately equal.

For simplicity, it is convenient to think of the bias in terms of a direct current superimposed on the alternating current. The direct current voltage will most usually be from about 0.25 V to about 10 V and no more than about 70% of the rms voltage of the alternating current; and this is particularly so when the bias is in a cathodic direction, i.e. the potential of the Al sheet is made more cathodic than would normally be the case. In laboratory experiments using 7 V AC, the inventors have found it convenient to superimpose a DC bias of from +4 V to −2 V on the alternating current. With commercial production lines operating at 30–60 V AC, the required DC bias is expected to be somewhat greater.

As the aluminium current is biased further in an anodic direction, that is to say as the aluminium sheet is made more anodic, i.e. as the overlying electrode is made more cathodic, then the rate of graining is slowed down. More importantly, as the current is biased further and further in the cathodic direction, then the formation of a pitting structure on the surface slows down and eventually stops. In this state, the (mainly) cathodic AC is cleaning the surface of loose debris but is no longer removing metal to form pits.

A convenient way of measuring bias is to plot the potential of the Al sheet, or alternatively the alternating current applied to the electrodes, against time, and compare the areas under the curves on each side of the zero (potential or current) line. With no bias, the areas are equal. With a bias, the areas are unequal. It is preferred that the bias be of limited extent, particularly in the cathodic direction, such that the ratio of the areas is no greater than about 3:1.

The method of this invention involves biasing the AC, for a time sufficient at least to initiate formation of a pitting structure on the Al surface. For the above reason, this time may depend on the extent of the bias.

It is preferred that the alternating current be initially biased in an anodic direction, and then biased in a cathodic direction. On the theoretical explanation offered above, this might be expected to result in the initial formation of scattered large pits on the Al metal surface, followed by the formation of a larger number of smaller pits. Alternatively, the AC may be initially biased in a cathodic direction and then biased in an anodic direction. Or the initial bias may be by a relatively larger direct current in the anodic direction and the second bias may be by a relatively smaller direct current also in the anodic direction. The statement that the AC is biased in a particular way includes the possibility of applying no bias at all in one part of the electrochemical roughening operation. The invention also includes the possibility of changing the bias more than once, e.g. twice or several times, during the roughening, and this may be convenient in continuous operation on a commercial scale. Instead of abruptly changing the bias from a first value to a second value, substantially the same effect can be achieved by a gradual change; if the change is sufficiently gradual, formation of the first pitting structure may merge into formation of the second pitting structure.

The initial bias is continued for a time sufficient at least to initiate formation of a first pitting structure on the surface. This means that the Al sheet is subjected to AC, biased in the first way, until pits have at least started to form, and preferably until a substantial degree of pit formation has taken place. Similarly, the AC is then biased in the second way for a time sufficient at least to initiate formation of a second pitting structure on the surface of the Al sheet. As noted above, the pitting structure is a function of the DC bias. When the initial DC bias is in an anodic direction, a period of from 1 to 15 seconds is likely to be sufficient to initiate and grow pits in a relatively coarse structure on the surface of the Al sheet.

The aqueous electrolyte used in the method of this invention can be one used in conventional electrochemical roughening processes. Electrolytes based on nitric acid are preferred, but those based on hydrochloric acid are also possible. In a nitric acid electrolyte, an initial anodic bias forms relatively large pits, and a subsequent cathodic bias allows the subsequent fine pitting to decorate the bases of the large pits. Conventional additives to such electrolytes include boric acid with nitric acid, and acetic, tartaric, formic and other organic acids with hydrochloric acid. Electrolyte concentration is preferably in the range 1–250 g/l, preferably 5–100 g/l, and electrolyte temperature is preferably from 20°–60° C. Temperature has only a small influence on graining speed.

The term Al sheet is used herein to include sheets of pure aluminium and of alloys containing a major proportion of aluminium. Alloys conventionally used to make lithographic plate supports by electrochemical roughening, are suitable for use. The method of this invention should make it possible to use other Al alloys, e.g. those containing Ti, which have desirable properties (resistance to bake softening) but which are difficult to electrograin under conventional conditions by virtue of forming a protective surface film. Suitable alloys are found in the 1000, 3000, 5000 and 6000 series, e.g. 1050 A of the Aluminum Association designation.

Commercial electrograining equipment comprises a series of baths containing electrolyte, each supplied with one electrode generally of graphite; or a single elongated bath of electrolyte containing a series of electrodes. A strip of Al sheet is passed continuously through the electrolyte and successively facing the electrodes. Alternatively, the strip may be contacted by a conducting roll and also passes through the electrolyte facing one or more counter-electrodes. In the case of a single elongated bath, barriers are provided between the electrodes to prevent short-circuiting through the electrolyte. The electrodes may be connected in one or more pairs, with alternating current passing from a first electrode to the Al sheet and thence to the second electrode. Where a direct current is superimposed on this AC circuit, the first electrode may be biased in a cathodic direction (so that the adjacent portion of the Al sheet is anodically biased) with the second electrode being correspondingly biased in an anodic direction. Where the AC is supplied in three separate phases R, S and T, it may be convenient to provide two pairs of electrodes in series R-S and T-R, with the first electrode of each pair being cathodically biased. Other combinations e.g. RST or RSTR can be used. The DC bias can be changed on each electrode individually in a cascade or even in a more variable manner.

The treated sheets are suitable as supports for lithographic plates, by virtue of having an average roughness $R_a$ (measured by an optical technique) in the range 0.5 μm to 2.5 μm depending on intended use. The lithographic plate supports may be further treated in a conventional way, e.g. by anodic oxidation, treatment with alkali metal silicates or cellulose derivatives, etc. Then a photosensitive layer is applied, and the plate is ready for use.

To further speed up the electrograining process, it is possible to clean the metal surface by briefly applying, either a short burst of imposed DC, or ultrasound.

Advantages of the method of the invention include:

Electrochemical graining can be effected as quickly or more quickly than by conventional techniques, and with improved control over surface microstructure.

It is possible to make several different kinds of litho plate support on the same line and using the same electrolyte, merely by altering the extent or the timing of the imposed DC bias.

It is possible to use Al alloys that cannot be electrochemically grained by conventional means. For example, high Ti alloys are desired for their improved bake softening properties but are difficult to electrograin. This difficulty should be overcome by the DC bias technique herein described.

It is standard practice to roughen aluminium sheet for use as capacitor foil by electrochemical means. Conditions are generally similar to those used for aluminium litho sheet, except that the acid is usually hydrochloric rather than nitric, and may be used at somewhat higher concentration. The method of this invention, involving biased alternating current, may be used to electrochemically roughen capacitor foil in the same way as litho sheet and gives rise to the same advantages.

Figure 2:
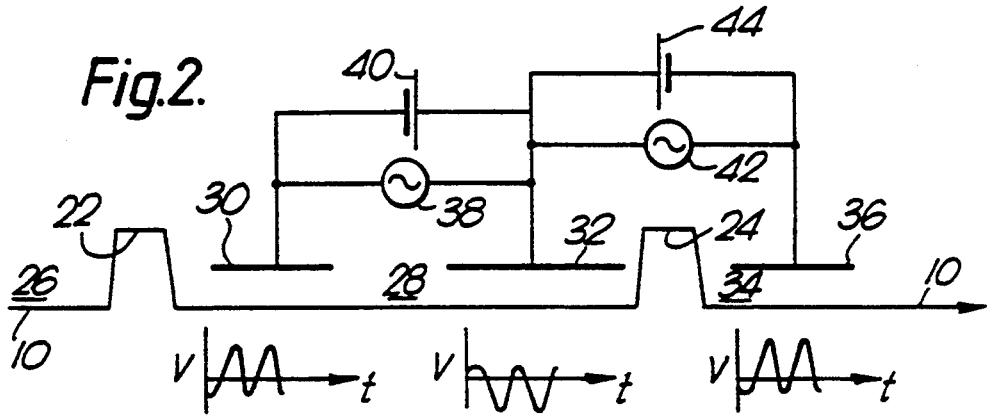
Figure 3:
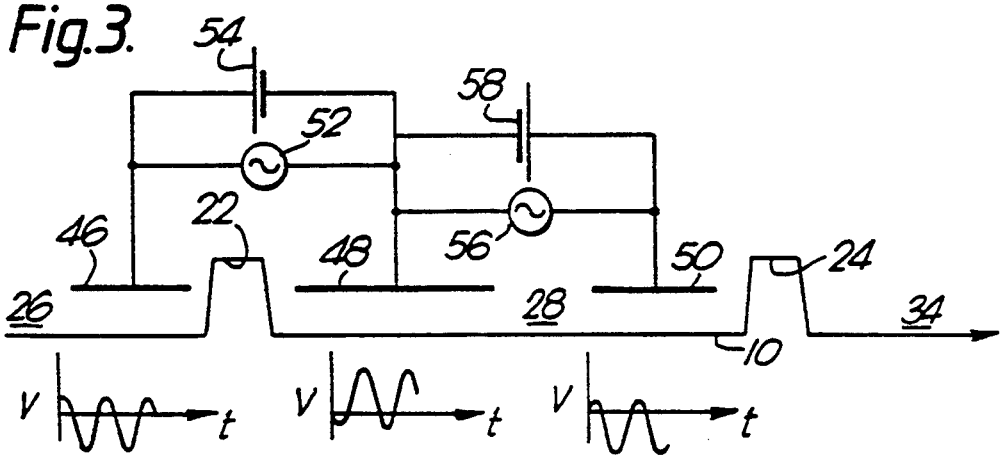

Reference is directed to the accompanying drawings in which each of FIGS. 1 to 3 is a diagram showing equipment for performing the method of this invention.

Referring to FIG. 1, aluminium sheet in the form of a continuous strip 10 is passed continuously under a pair of graphite electrodes 12, 14. The strip and the electrodes are immersed in a bath of electrolyte not shown. Applied to the electrodes is an alternating current from a power source 16. Superimposed on that is a direct current from a further power source comprising a negative terminal 18 and a positive terminal 20. Immediately below the electrode 12 is a small plot of the potential of the strip at that point against time. The line of the time axis represents zero potential. It can be seen that the areas under the curves above this horizontal line are larger than those below it; thus the aluminium strip is anodically biased at this point. A corresponding plot under the electrode 14 shows that the aluminium strip is cathodically biased at that point. The whole operation is performed in a single bath and is symmetrical.

Referring now to FIG. 2, the aluminium strip is again shown as 10, with jinks at 22 and 24 to indicate passage from one bath of electrolyte to another. The aluminium strip passes through a cleaning bath 26, with no external power supply; a graining bath 28 containing electrodes 30 and 32; and an anodising bath 34 containing an electrode 36. A power supply 38 supplies alternating current to electrodes 30 and 32. A further power supply 40 superimposes a direct current on that alternating current. Further power supplies 42 and 44 supply respectively alternating and direct current between electrodes 32 and 36. As a result, the aluminium strip is anodically biased below electrode 30; cathodically biased below electrode 32; and anodically biased again below electrode 36. In the electrograining bath 28, the extent of cathodic bias is greater than the extent of anodic bias.

FIG. 3 shows a similar system. The aluminium strip 10 passes through a cleaning bath 26 containing an electrode 46; an electrograining bath 28 containing electrodes 48 and 50; and an anodising bath with no power source shown. Power sources 52 and 54 impose alternating current and direct current respectively on electrodes 46 and 48. Power sources 56 and 58 impose alternating current and direct current respectively on electrodes 48 and 50. The result is that the aluminium strip is anodically biased under the electrode 48 and cathodically biased under the electrode 50. The extent of anodic bias is greater than the extent of cathodic bias in the graining bath. The balance of cathodic bias is used up in the cleaning bath 26.

FIGS. 2 and 3 show how the anodic and cathodic bias of the aluminium strip in the electrograining bath (or baths) can each be varied independently of the other.

The following examples illustrate the invention. Examples 1 and 2 provide background data.

EXAMPLE 1

The alloy used was AA1050A (Fe, 0.38; Si, 0.08; Ti, 0.01; balance Al plus normal impurities). Samples were grained in a laboratory cell that had been shown to produce surfaces similar to those produced commercially. The electrolyte was 1% nitric acid. The voltage applied was 7 V AC and the electrode spacing was 15 mm. On this alternating current, a direct current was superimposed whose size was fixed for each experiment but different between different experiments. The following table reports the time taken to pass 34 positive kCoulombs $m^{-2}$ (sufficient to effect electrochemical roughening of the surface), against the imposed DC; positive values indicate that the Al sheet sample was made more anodic by the superimposed DC.

TABLE

| Superimposed DC (Volts) | Time for Electrograining (seconds) | Charge Density (kCoulombs.$m^{-2}$) |
|---|---|---|
| −2 | 33.6 | 92.7 |
| −1 | 31.3 | 88.6 |
| 0 | 27.2 | 83.6 |
| 1 | 21.9 | 75.1 |
| 1.5 | 20.1 | 73.2 |
| 2 | 18.3 | 71.5 |
| 3 | 16.1 | 70.2 |
| 4 | 13.5 | 66.1 |

The microstructures of the samples grained with a +1 to +4 V bias showed mainly large pits above 10 μm diameter with substantial flat plateaus in between. Samples grained with a −2 to 0 V bias showed a uniform structure of pits mainly below 10 μm diameter, typical of the surfaces conventionally produced when electrograining under these conditions. Under the particular conditions of this experiment, the dividing line between the two types of structures appears to lie between 0 and +1 V bias.

To investigate this phenomenon further, samples were electrograined for various short times using a superimposed DC bias of either +1.5 V or −1 V. At +1.5 V bias, large pits are initiated rapidly and grow with time, remaining areas of the metal surface being unaffected. At −1 V bias a general coverage of fine pits is formed more slowly. The micrographs showing these phenomena have not been included because they would not reproduce well in a patent specification.

EXAMPLE 2

Experiments were performed as in Example 1 but using a 1.5 wt % hydrochloric acid electrolyte and 11.5 V. The following table relates DC bias to time required for electrograining (taken as the time taken to pass 33.7 positive kCoulombs $m^{-2}$).

TABLE

| DC Bias (Volts) | Time for Electrograining (seconds) | Charge Density (kCoulombs.$m^{-2}$) |
|---|---|---|
| −6 | 22 | 87.2 |
| −4 | 16 | 81.3 |
| −2 | 13.5 | 72.8 |
| 0 | 12.5 | 70.0 |
| 2 | 91.5 | 67.6 |
| 4 | 8 | 64.3 |
| 6 | 6.5 | 60.6 |
| 8 | 6 | 59.6 |

As in Example 1, the time required for electrograining is substantially reduced by increasing the anodic bias. An anodic bias gave deeper single pits resulting from cubic attack, while a cathodic bias gave normal graining. In this case, the boundary between the two graining regimes appeared to be in the region of −2 to 0 V.

EXAMPLE 3

This experiment was performed using a nitric acid electrolyte under the conditions of Example 1. But the imposed DC bias was changed once during the electrograining operation. Specifically, the sample was treated for 4 seconds with a 7 V alternating current on which was superimposed a 1 V DC bias, the sample being biased in the anodic direction. Then the direct current was reversed, so that the sample was biased by 1 V in a cathodic direction, and electrochemical roughening continued for a further 11 seconds. The treated sample had a microstructure completely covered with pits, comprising a mixture of larger pits around 10 μm average diameter, and a superimposed structure of smaller pits, and was very suitable for use as a lithographic plate support. It should be noted that treatment was effected in 15 seconds, and the charge density used was 52 kCoulombs $m^{-2}$. As the Table in Example 1 shows, there is no single set of conditions by which treatment can be effected in less than about 27 seconds. Conventional graining which was only influenced by the natural bias would use approximately 89 kCoulombs $m^{-2}$.

EXAMPLE 4

This experiment was performed in a similar manner to that described in Example 3. The times of the two stages were each 8 seconds. This would be particularly favourable for commercial implementation as this represents putting a DC supply in parallel with the AC source of a symmetrical liquid contact line. Thus the strip would be biased positively in the first half cell and then experience an equal but opposite bias in the other half cell. Again a similar surface to that described above was produced with a charge density of 44 kCoulombs $m^{-2}$.

EXAMPLE 5

This experiment was performed under the same conditions as mentioned in Example 2 using hydrochloric acid electrolyte. The imposed DC bias was changed once during the experiment. The sample was treated for 2 seconds with an 11.5 V AC voltage on which was superimposed a 4 V anodic bias. then the DC voltage was changed to 4 V cathodic bias for a further 8 seconds. The surface was similar to that produced in unassisted AC graining in 16 seconds using 83 kCoulombs $m^{-2}$ but here only 63 kCoulombs $m^{-2}$ were needed. The roughness of the sample grained without superimposing a bias had a centre line average roughness ($R_a$) of 1.48 μm and the sample grained in this example had a $R_a$ of 1.45 μm.

EXAMPLE 6

Another experiment was carried out in a similar manner to that described in Example 5 but with the anodic and cathodic biases applied for equal times: namely 4 seconds. The charge density was 59 kCoulombs $m^{-2}$ and the roughness $R_a$ was 1.32 μm. Nevertheless this roughness lies within the acceptable range for lithographic plate of this type. Again this demonstrates that the usual processing time can be halved and at reduced charge.

EXAMPLE 7

This experiment was performed in a similar manner to that described in Example 3. The conditions of the two stage process were −0.5 volts applied for 18 s followed by −1 volt for 8 s. The surface obtained was similar to that reported in Examples 3 and 4 and the charge density used was 79 kCoulombs $m^{-2}$. This experiment shows that it is not necessary to bias the sample in opposite directions to improve efficiency.

EXAMPLE 8

This experiment was performed in a similar manner to that described in Example 4. The conditions of the two stage process were 1.0 volts applied for 8 s followed by 0 volt for 8 s. The surface obtained was similar to that reported in Examples 3, 4 and 7 but with a greater number of coarse pits and less attack of the plateau regions. This shows that a multiple bias arrangement can include a neutral bias stage. The charge density used was 51 kCoulombs $m^{-2}$.

EXAMPLE 9

To demonstrate that this technique is applicable to alternative alloys two different lithographic compositions were trialled. The significant alloying components are shown in the table below.

| Sample | Fe | Si | Ti | Mn | kCoulombs $m^{-2}$ |
|---|---|---|---|---|---|
| AA1050A (High Ti) | 0.38 | 0.08 | 0.03 | | 52 |

-continued

| Sample | Fe | Si | Ti | Mn | kCoulombs $m^{-2}$ |
|---|---|---|---|---|---|
| AA3103 | 0.55 | 0.10 | 0.01 | 1.1 | 53 |

The graining experiments were performed on each alloy in a similar manner to that described in Example 4. The resulting surfaces were all fully grained. In the case of the high titanium alloy the surface was very similar to those seen in Examples 3, 4 and 7 thus demonstrating that this process has the ability to grain materials that have a tendency to film under conventional graining conditions.

The 3103 material again exhibited a similar surface to the above but had less plateau thus causing the pits to have thinner side walls and leading to a satisfactory more open structure.

We claim:

1. A method of electrochemically roughening a surface of an A1 sheet, by subjecting the sheet in an aqueous electrolyte to the action of an alternating electric current, characterised in that the AC is initially biased in a first way for a time sufficient at least to initiate formation of a first pitting structure on the surface, and is then biased in a second way for a time sufficient at least to initiate formation of a second pitting structure on the surface, wherein a bias in a cathodic direction is of limited extent, such that the ratio of the areas, on opposite sides of a zero potential line under the curve of a voltage/time plot, is no greater than about 3:1.

2. A method as claimed in claim 1, wherein the A1 sheet is for use as a lithographic printing plate support.

3. A method as claimed in claim 1, wherein the aqueous electrolyte is based on $HNO_3$.

4. A method as claimed in claim 1, wherein the aqueous electrolyte is based on HCl.

5. A method as claimed in claim 1, wherein a length of the A1 sheet is continuously passed through the aqueous electrolyte of at least one electrochemical roughening cell, each portion of the sheet being subjected first to AC biased in the said first way and then to AC biased in the second way.

6. A method as claimed in claim 1, wherein the AC is first biased in an anodic direction and is then biased in a cathodic direction.

7. A method as claimed in claim 5, wherein the AC is biased in an anodic direction for a period of 1 to 15 seconds.

8. A method as claimed in claim 1, wherein the bias of the AC is changed two or more times during treatment of the A1 sheet.

* * * * *